US010791784B2

(12) United States Patent
Kang

(10) Patent No.: US 10,791,784 B2
(45) Date of Patent: Oct. 6, 2020

(54) GLASS FOR HELMET

(71) Applicant: TAEYOUNG INC., Gyeonggi-do (KR)

(72) Inventor: Tae-Ki Kang, Gyeonggi-do (KR)

(73) Assignee: TAEYOUNG INC., Gyeonggi-Do (KR)

( * ) Notice: Subject to any disclaimer, the term of this patent is extended or adjusted under 35 U.S.C. 154(b) by 0 days.

(21) Appl. No.: 16/353,230

(22) Filed: Mar. 14, 2019

(65) Prior Publication Data

US 2020/0163396 A1 May 28, 2020

(30) Foreign Application Priority Data

Nov. 26, 2018 (KR) ..... 10-2018-0147260

(51) Int. Cl.

| | |
|---|---|
| ***A42B 3/04*** | (2006.01) |
| ***A42B 3/22*** | (2006.01) |
| ***A42B 3/18*** | (2006.01) |
| ***A42B 3/06*** | (2006.01) |
| ***A42B 1/08*** | (2006.01) |

(52) U.S. Cl.

CPC ..... *A42B 3/042* (2013.01); *A42B 1/08* (2013.01); *A42B 3/06* (2013.01); *A42B 3/066* (2013.01); *A42B 3/18* (2013.01); *A42B 3/185* (2013.01); *A42B 3/22* (2013.01); *A42B 3/221* (2013.01); *A42B 3/222* (2013.01); *A42B 3/223* (2013.01)

(58) Field of Classification Search

CPC .. A42B 3/042; A42B 3/22; A42B 3/18; A42B 3/221; A42B 3/222; A42B 3/223; A42B 3/06; A42B 3/066; A42B 3/185; A42B 1/08

USPC ..... 2/410

See application file for complete search history.

(56) References Cited

U.S. PATENT DOCUMENTS

| | | | | |
|---|---|---|---|---|
| 3,383,155 A * | 5/1968 | Bourke | A61F 9/061 | 351/155 |
| 4,449,787 A * | 5/1984 | Burbo | A42B 3/042 | 313/524 |
| 5,408,086 A * | 4/1995 | Morris | G02B 23/125 | 250/214 VT |
| 5,412,812 A * | 5/1995 | Gatchalian | A42B 1/247 | 2/10 |
| 5,533,207 A * | 7/1996 | Diaz | A42B 1/247 | 2/10 |

(Continued)

FOREIGN PATENT DOCUMENTS

KR 2019950004436 2/1995

*Primary Examiner* — Khaled Annis
*Assistant Examiner* — Dakota Marin
(74) *Attorney, Agent, or Firm* — IPLA P.A.; James E. Bame

(57) ABSTRACT

Glasses for a helmet is configured to rotate a glass member in a state where the glass member is mounted onto the helmet by means of one touch, thereby allowing the glass member to be located in front of a wearer's eyes, and configured to reversely rotate the glass member, thereby opening the front sides of his or her eyes. The glasses for a helmet includes: helmet attachment members fixedly attached to the helmet worn on a wearer's head; glass mounting members separably mounted onto the helmet attachment members by means of one touch; and a glass member adapted to rotate in a state of being rotatably fixed to the glass mounting members in such a manner as to be located in front of the wearer's eyes.

7 Claims, 8 Drawing Sheets

(56) References Cited

U.S. PATENT DOCUMENTS

| | | | | |
|---|---|---|---|---|
| 8,286,269 | B2 * | 10/2012 | Springer | A42B 3/185 2/10 |
| 9,833,032 | B2 * | 12/2017 | Jacobsen | A42B 3/283 |
| 2009/0307816 | A1 * | 12/2009 | Stachler | A42B 3/185 2/10 |
| 2009/0307817 | A1 * | 12/2009 | Stachler | A42B 3/185 2/10 |
| 2011/0069273 | A1 * | 3/2011 | Lu | G02C 3/02 351/51 |
| 2014/0013480 | A1 * | 1/2014 | Treger | G02C 3/02 2/10 |
| 2014/0173811 | A1 * | 6/2014 | Finiel | A42B 3/04 2/422 |

* cited by examiner

GLASS FOR HELMET

BACKGROUND

The present invention relates to glasses for a helmet that is configured to rotate a glass member in a state where the glass member is mounted onto the helmet by means of one touch, thereby allowing the glass member to be located in front of a wearer's eyes, and configured to reversely rotate the glass member, thereby opening the front sides of his or her eyes.

Generally, a helmet is used to protect a wearer's head in various leisure and sports activities such as inline skating, bicycle riding, scooter riding, climbing, horseback riding, and so on.

Even if the wearer wears the helmet for long hours, the helmet has to protect his or her head, while giving no inconveniences to him or her.

Unlike motorbike helmets adapted to surround the wearer's entire face, further, most of helmets for leisure and sports activities surround only the upper side of the wearer's head, so that he or she should wear separate safety glasses.

In the state where he or she wears the helmet, however, it is inconvenient to put on or take off the safety glasses, and the safety glasses may be unexpectedly taken off due to his or her severe body motions caused by the leisure and sports activities.

The above-mentioned conventional practice is disclosed in Korean Utility Model Application No. 1996-0002302 (Filed on Mar. 20, 1996).

SUMMARY OF THE INVENTION

Accordingly, the present invention has been made in view of the above-mentioned problems occurring in the prior art, and it is an object of the present invention to provide glasses for a helmet that is configured to rotate a glass member in a state where the glass member is mounted onto the helmet by means of one touch, thereby allowing the glass member to be located in front of a wearer's eyes, and configured to reversely rotate the glass member, thereby opening the front sides of his or her eyes.

To accomplish the above-mentioned object, according to the present invention, there is provided glasses for a helmet including: helmet attachment members fixedly attached to the helmet worn on a wearer's head; glass mounting members separably mounted onto the helmet attachment members by means of one touch; and a glass member adapted to rotate in a state of being rotatably fixed to the glass mounting members in such a manner as to be located in front of the wearer's eyes.

According to the present invention, desirably, the helmet has a plurality of mounting portions formed open downward in an internal space thereof in such a manner as to mount the helmet attachment members thereonto and the helmet attachment members are inserted correspondingly into the mounting portions.

According to the present invention, desirably, the mounting portions are formed of pipe bodies, and the helmet attachment members include: installation pipe bodies insertedly fitted to the mounting portions of the helmet; installation magnets disposed in the installation pipe bodies to provide magnetic forces therefrom; and locking protrusions formed on the outer peripheral surfaces of the installation pipe bodies in such a manner as to be fixedly locked onto the inner peripheral surfaces of the mounting portions.

According to the present invention, desirably, the glass mounting members include: a glass coupling part separably coupled to the glass member; rotation support parts disposed on both sides of the glass coupling part; rotation parts separably fixed to the helmet attachment members in a state of being rotatably fixed to the rotation support parts; rotation stoppers movably disposed in the rotation parts in such a manner as to be supported against the rotation support parts to maintain the rotating states of the rotation parts in the rotation support parts; and fastening members for rotatably fastening the rotation parts to the rotation support parts.

According to the present invention, desirably, the glass coupling part includes: a base plate supported against top of the glass member; front plates disposed extended forward from the base plate in such a manner as to be supported against the front surface of the glass member; rear plates disposed extended backward from the base plate in such a manner as to be supported against the rear surface of the glass member; and coupling protrusions formed on the front plates and the rear plates in such a manner as to be coupled to the glass member, and the glass member includes coupling holes coupled to the coupling protrusions of the glass coupling part.

According to the present invention, desirably, each rotation support part includes: a support rod erected on the glass member; a fixing body disposed on top of the support rod and having a fixing hole formed thereon to fasten the corresponding fastening member thereto; and a plurality of fixing protrusions formed on the outer peripheral surface of the fixing body.

According to the present invention, desirably, each rotation part includes: a rotation pipe body having an internal space penetrated on both ends thereof; a rotation magnet disposed on one end of the rotation pipe body in such a manner as to be separably fixed to the corresponding helmet attachment member; rotation pieces disposed on both sides of the other side of the rotation pipe body in such a manner as to be rotatably fastened to the rotation support part by means of the fastening member; and guides formed in an internal space of the rotation pipe body to guide the movement of the rotation stopper.

According to the present invention, desirably, each rotation stopper includes: an elastic body disposed in the internal space of the rotation part to provide elasticity; a stopper body inserted into the internal space of the rotation part; guide protrusions formed on the stopper body in such a manner as to be guided along the guides of the rotation part and supported against the elastic body; and stopper protrusions formed on the end portion of the stopper body in such a manner as to be supported against the rotation support part of the corresponding glass mounting member.

According to the present invention, desirably, the guides are formed on both sides of the internal space of the rotation pipe body, and the guide protrusions are formed on both sides of the stopper body in such a manner as to be inserted into the guides to prevent the stopper body from rotating.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, Hereinafter, the present invention is in detail disclosed with reference to the attached drawings.

Figure 1:
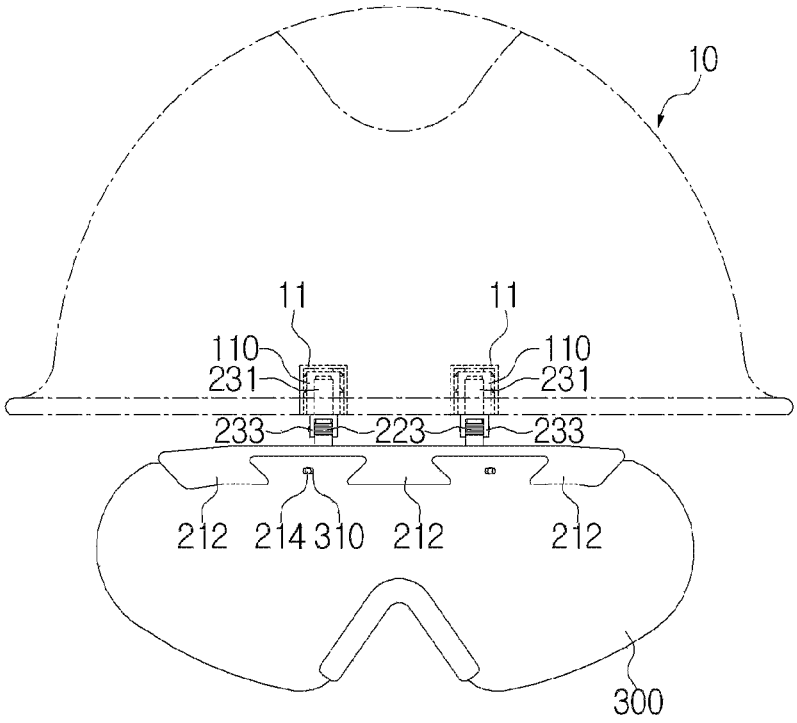
FIG. 1 is a front view showing glasses for a helmet according to the present invention, wherein a glass member is mounted on the helmet.
Figure 2:
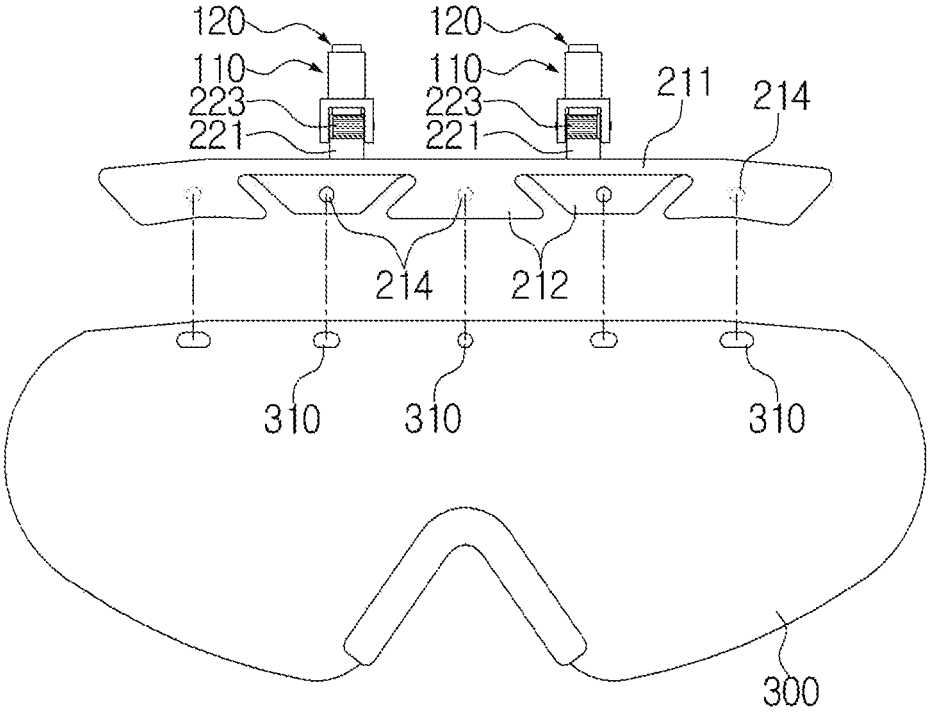
FIG. 2 is a front view showing the glass member in the glasses for a helmet according to the present invention.
Figure 3:
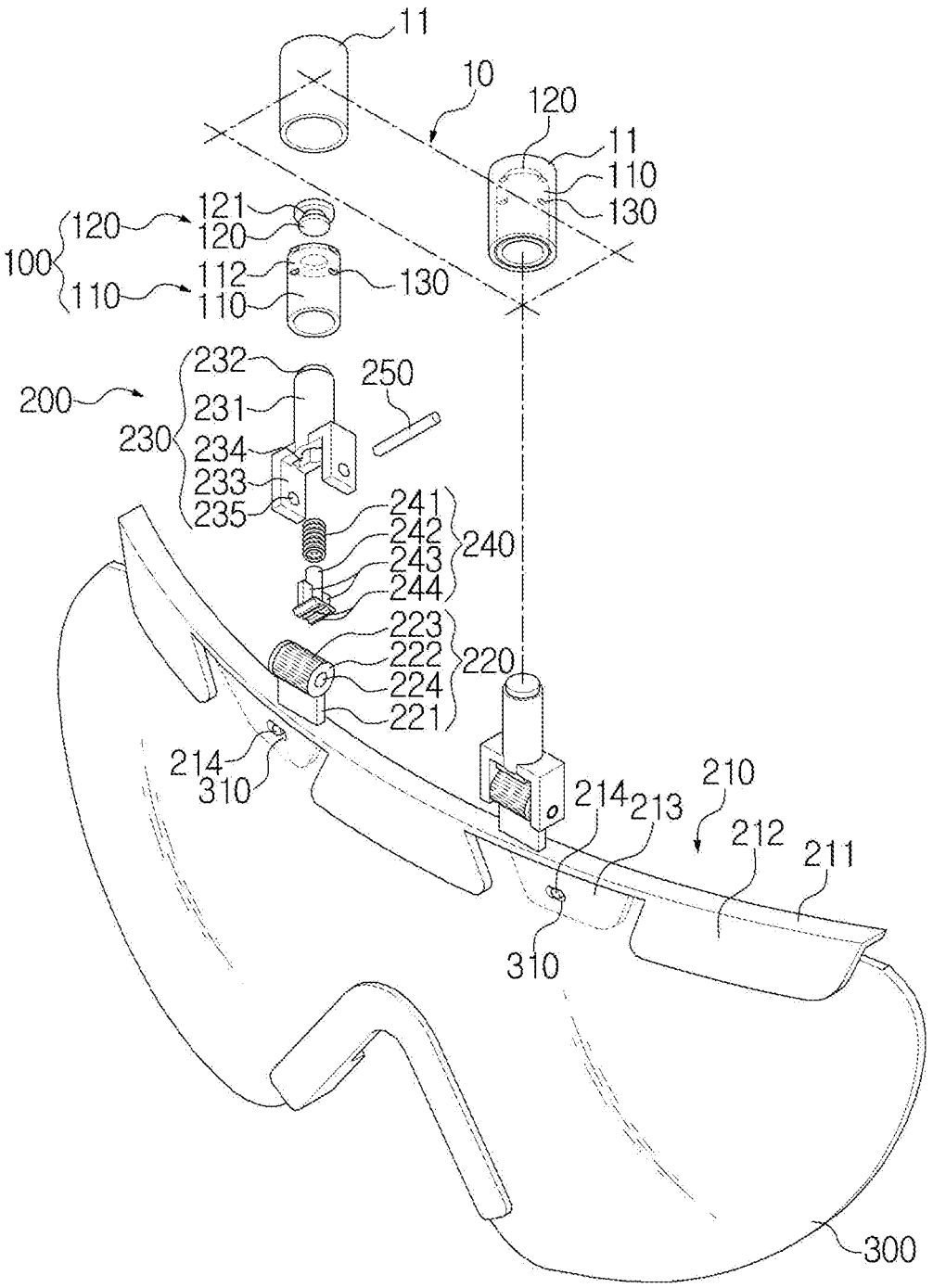
FIG. 3 is an exploded perspective view showing the glasses for a helmet according to the present invention.
Figure 4A:
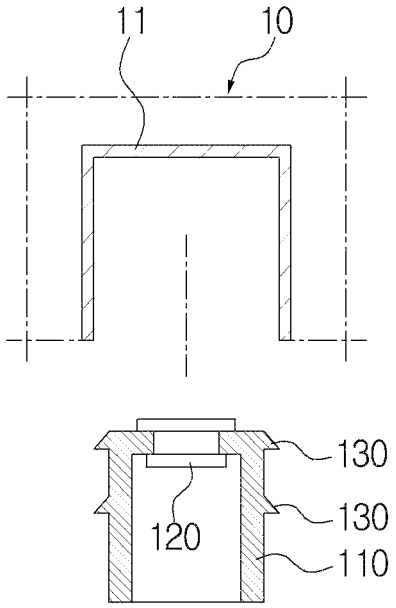
FIGS. 4*a* and 4*b* are front views showing processes for fixing helmet attachment members to the helmet.
Figure 4B:
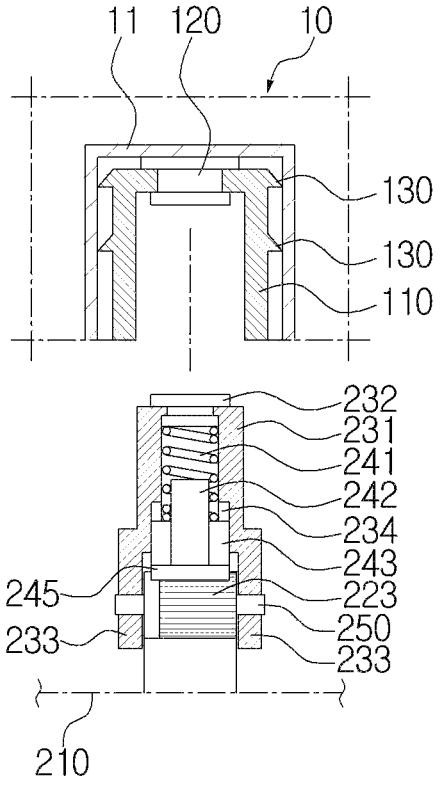
Figure 5A:
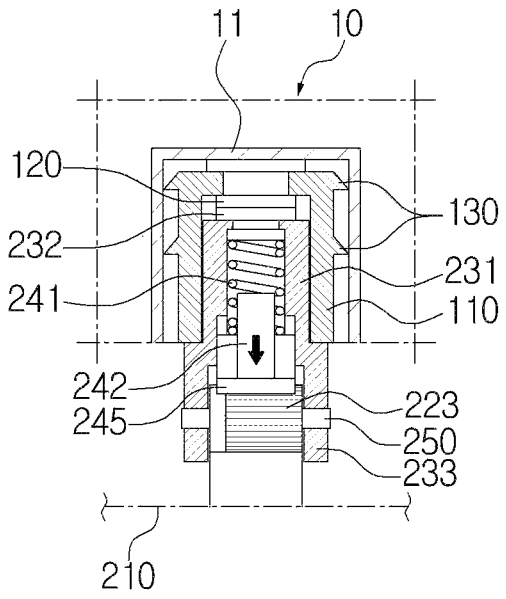
FIGS. 5*a* and 5*b* are front views showing states wherein glass mounting members are ascended and descended to and from the helmet attachment members.
Figure 5B:
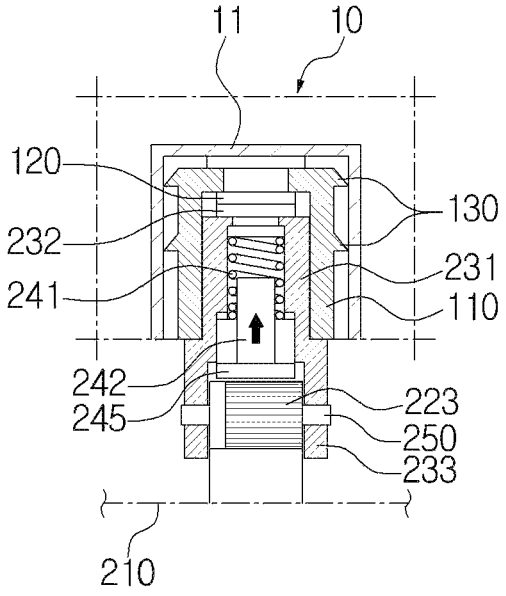
Figure 6:
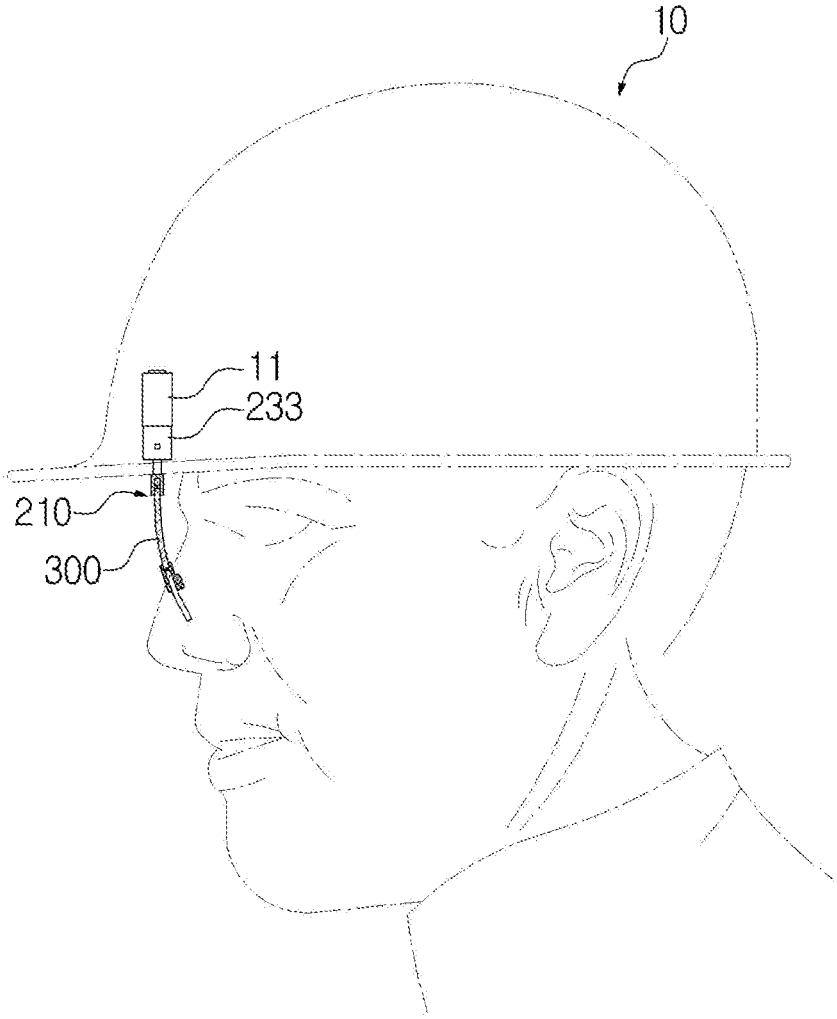
FIG. 6 is a schematic view showing a state wherein the glass member rotates downward from the helmet.
Figure 7:
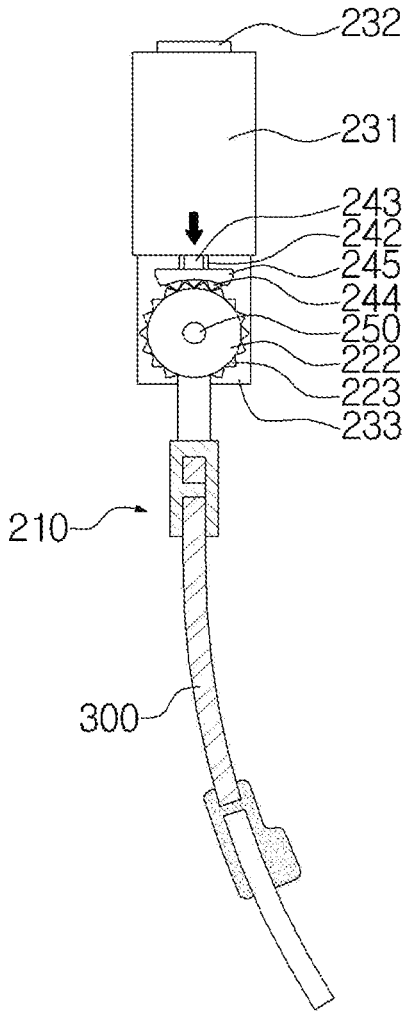
FIG. 7 is a side view showing the downward rotating state of the glass member.
Figure 8:
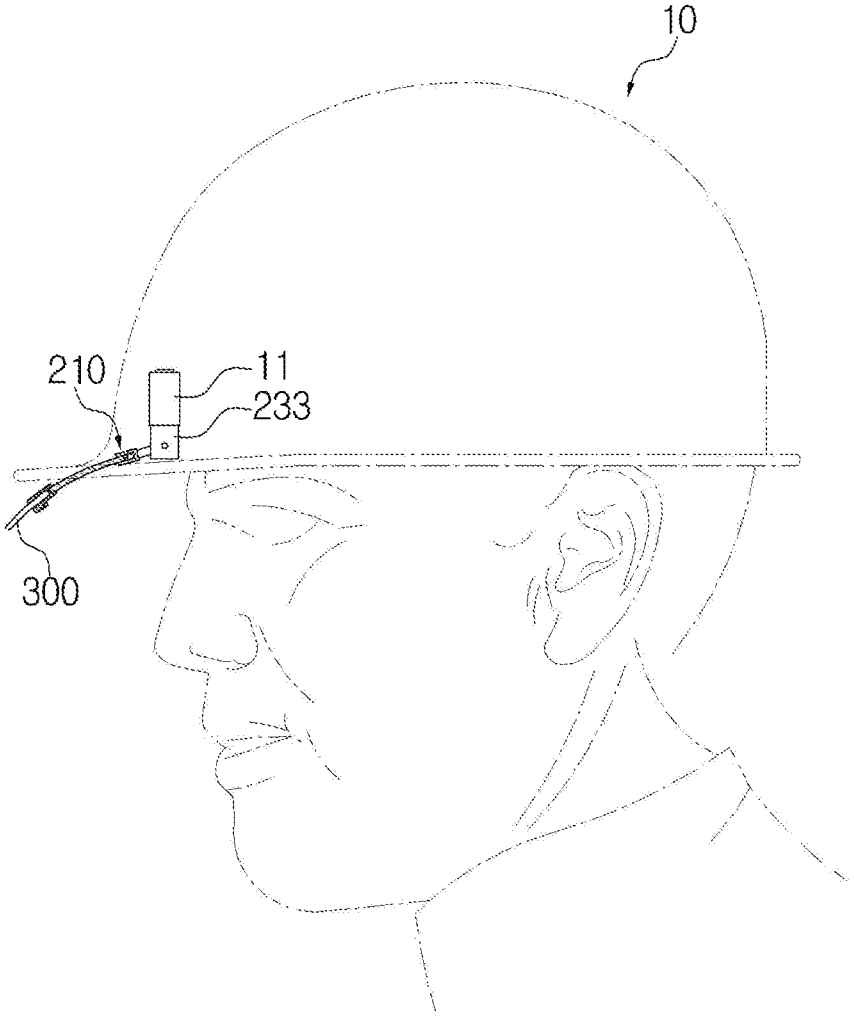
FIG. 8 is a schematic view showing a state wherein the glass member rotates upward from the helmet.
Figure 9:
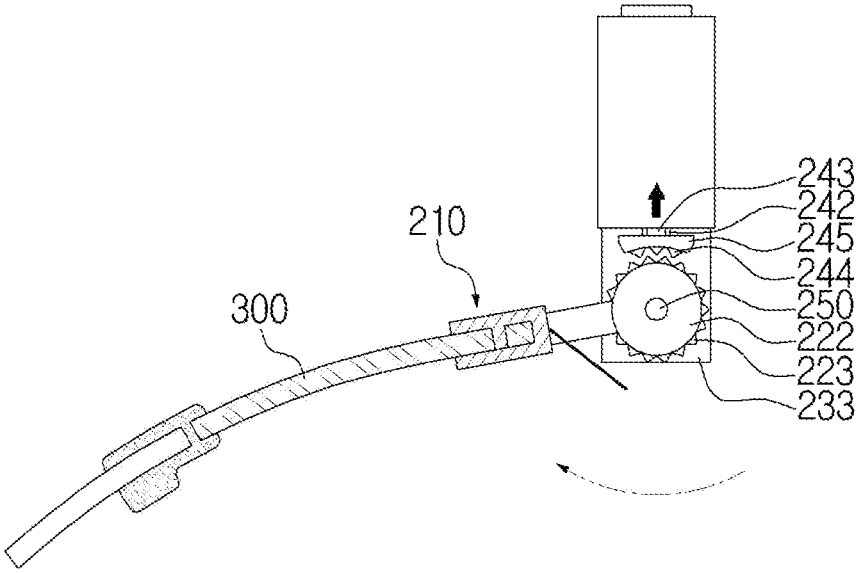
FIG. 9 is a side view showing the upward rotating state of the glass member.

As shown in FIGS. 1 to 9, glasses for a helmet according to the present invention includes helmet attachment members 100 fixedly attached to the helmet 10 worn on a wearer's head, glass mounting members 200 separably mounted onto the helmet attachment members 100 by means of one touch, and a glass member 300 adapted to rotate in a state of being rotatably fixed to the glass mounting members 200 in such a manner as to be located in front of the wearer's eyes.

First, the helmet 10 serves to protect the wearer's head from the outside, which is used while he or she is riding horseback, bicycle, motorbike, and so on.

The helmet 10 has mounting portions 11 formed open downward in an internal space thereof in such a manner as to mount the helmet attachment members 100 thereonto. Further, the mounting portions 11 are formed of pipe bodies spaced apart from each other on the front side of the helmet 10. At this time, the mounting portions 11 have grooves or holes formed on the inner peripheral surfaces thereof in such a manner as to lock locking protrusions 130 as will be discussed later thereonto. If the mounting portions 11 are not used, also, they are closed by means of stoppers to prevent foreign matters from being introduced thereinto.

The helmet attachment members 100 include installation pipe bodies 110 insertedly fitted to the mounting portions 11 of the helmet 10, installation magnets 120 disposed in the installation pipe bodies 110 to provide magnetic forces therefrom, and the locking protrusions 130 formed on the outer peripheral surfaces of the installation pipe bodies 110 in such a manner as to be fixedly locked onto the inner peripheral surfaces of the mounting portions 11.

The installation pipe bodies 110 are inserted correspondingly into the mounting portions 11.

If the installation pipe bodies 110 are mounted onto the mounting portions 11 in a state of being fixed to the glass member 300, in this case, the glass member 300 can be rigidly kept to a fixed state, while being not rotated around the installation pipe bodies 110. Accordingly, the glass member 300 is rigidly maintained in a state of being mounted onto the front side of the helmet 10, so that it can be accurately located on the face of the wearer.

Further, each installation pipe body 110 has an inward projection 112 protruding inwardly from the end thereof in such a manner as to fixedly lock the installation magnet 120 thereonto.

Each installation magnet 120 has a locking groove 121 formed on the outer peripheral surface thereof in such a manner as to fixedly lock the inward projection 112 of the corresponding installation pipe body 110 thereonto.

The locking projections 130 are formed symmetrically to a shape of a triangle or wedge on each installation pipe body 110 in such a manner as to be locked onto the inner peripheral surface of the corresponding mounting portion 11.

If the installation magnets 120 are forcedly inserted into the installation pipe bodies 110, the inward projections 112 of the installation pipe bodies 110 are fixedly locked onto the locking grooves 121 of the installation magnets 120. As a result, the installation magnets 120 are mounted onto the ends of the installation pipe bodies 110.

The glass mounting members 200 include a glass coupling part 210 separably coupled to the glass member 300, rotation support parts 220 disposed on both sides of the glass coupling part 210, rotation parts 230 separably fixed to the helmet attachment members 100 in a state of being rotatably fixed to the rotation support parts 220, rotation stoppers 240 movably disposed in the rotation parts 230 in such a manner as to be supported against the rotation support parts 220 to maintain the rotating states of the rotation parts 230 in the rotation support parts 220, and fastening members 250 for rotatably fastening the rotation parts 230 to the rotation support parts 220.

The glass coupling part 210 includes a base plate 211 supported against top of the glass member 300, front plates 212 disposed extended forward from the base plate 211 in such a manner as to be supported against the front surface of the glass member 300, rear plates 213 disposed extended backward from the base plate 211 in such a manner as to be supported against the rear surface of the glass member 300, and coupling protrusions 214 formed on the front plates 212 and the rear plates 213 in such a manner as to be coupled to the glass member 300.

The base plate 211 has a shape of a circular arch so that it can be accurately supported against the top end of the circular arch-shaped glass member 300.

The front plates 212 and the rear plates 213 are spaced apart from each other on left and right sides in such a manner as to be extended from the base plate 111 to increase the support forces against the glass member 300.

The coupling protrusions 214 are formed on the front plates 212 and the rear plates 213 in such a manner as to be penetratedly coupled to the glass member 300.

In a state where the front plates 212 are open from the rear plates 213 if the glass member 300 is fitted to the open space, accordingly, the coupling protrusions 214 are penetratedly coupled to the glass member 300.

Each rotation support part 220 includes a support rod 221 erected on the glass member 300, a fixing body 222 disposed on top of the support rod 221 and having a fixing hole 224 formed thereon to fasten the corresponding fastening member 250 thereto, and a plurality of fixing protrusions 223 formed on the outer peripheral surface of the fixing body 222.

The support rods 221 are disposed on both sides of the base plate 211 of the glass coupling part 210.

The fixing body 222 has a shape of a cylinder so as to guide the rotation stopper 240 along the outer peripheral surface thereof. The fixing hole 224 is penetratedly formed extended from one end of the fixing body 222 to the other end thereof.

Further, the fixing protrusions 223 are formed on the outer peripheral surface of the cylindrical fixing body 222. At this time, if the fixing protrusions 223 are formed from one end of the fixing body 222 to the other end thereof, the support force of the rotation stopper 240 is increased to firmly maintain the rotating state of the glass member 300, and if the fixing protrusions 223 are formed from one end of the fixing body 222 to the intermediate portion thereof, the support force of the rotation stopper 240 is decreased to easily manipulate the rotation of the glass member 300.

Each rotation part 230 includes a rotation pipe body 231 having an internal space penetrated on both ends thereof, a rotation magnet 232 disposed on one end of the rotation pipe body 231 in such a manner as to be separably fixed to the corresponding helmet attachment member 100, rotation pieces 233 disposed on both sides of the other side of the rotation pipe body 231 in such a manner as to be rotatably fastened to the rotation support part 220 by means of the fastening member 250, and guides 234 formed in an internal space of the rotation pipe body 231 to guide the movement of the rotation stopper 240.

The rotation pipe body 231 has a smaller diameter than the installation pipe body 110 of the helmet attachment member 100 so that it is inserted into the installation pipe body 110. Further, the rotation magnet 232 is forcedly inserted into the internal space of the rotation pipe body 231 and is thus fixed to the rotation pipe body 231. In this case, if the glass member 300 is ascended toward the helmet 10 by means of the wearer, the rotation parts 230 are inserted into the installation pipe bodies 110 and then fixed thereto by means of magnetic forces, so that the attachment and detachment of the glass member 300 can be conveniently performed and the inserted states of the rotation pipe bodies 231 into the installation pipe bodies 110 can be rigidly maintained, without any movements.

The rotation magnets 232 are attached to the installation magnets 120 of the helmet attachment members 100 by means of magnetic forces thereof. In this case, any one of the rotation magnet 232 and the installation magnet 120 is made of a steel material. The rotation pieces 233 have fastening hole 235 formed correspondingly to the fixing hole 224 formed on the corresponding fixing body 222 in such a manner as to pass the fastening member 250 therethrough.

The guides 234 are formed on both sides of the internal space of the rotation pipe body 231.

Each rotation stopper 240 includes an elastic body 241 disposed in the internal space of the rotation part 230 to provide elasticity, a stopper body 242 inserted into the internal space of the rotation part 230, guide protrusions 243 formed on the stopper body 242 in such a manner as to be guided along the guides 234 of the rotation part 230 and supported against the elastic body 241, and stopper protrusions 244 formed on the end portion of the stopper body 242 in such a manner as to be supported against the rotation support part 220 of the corresponding glass mounting member 200.

The elastic body 241 is formed of a compression spring.

The stopper body 242 has a shape of a shaft so that it is fitted to the inside of the compression spring as the elastic body 241.

The guide protrusions 243 are formed on both sides of the stopper body 242 in such a manner as to be inserted into the guides 234 to prevent the stopper body 242 from rotating. As the stopper body 242 does to rotate, as a result, the rectangular stopper protrusions 244 can be easily inserted into the spaces between the fixing protrusions 223.

Also, the guide protrusions 243 are supportedly locked onto the compression spring as the elastic body 241.

Each stopper protrusion 244 has a sectional shape of a triangle so that it can be fixedly fitted between the adjacent fixing protrusions 223, and also, it has a shape of a rectangular so that a fixed area thereof can be increased.

The stopper body 242 includes a support plate 245 having a concaved surface formed on the end portion thereof, and the stopper protrusions 244 are formed along the concaved surface of the support plate 245. As a result, the stopper protrusions 244 are fixedly fitted to the spaces between the fixing protrusions 223, thereby increasing the fixing force thereof.

If the rotation support parts 220 rotate downward around the rotation parts 230, together with the glass member 300, through the rotation of the glass member 300 by means of the wearer's manipulation, the glass member 300 is located in front of the wearer's eyes, and if the rotation support parts 220 rotate upward, together with the glass member 300, the glass member 300 is removed to open the front sides of the wearer's eyes.

The glass member 300 is mounted onto the helmet 10, and accordingly, it is transparent to transmit light thereto. Otherwise, it may be formed of sunglasses or safety glasses.

Further, the glass member 300 includes coupling holes 310 coupled to the coupling protrusions 214 of the glass coupling part 210. In detail, if the coupling protrusions 214 of the glass coupling part 210 are coupled to the coupling holes 310, the glass member 300 can be coupled to the glass coupling part 210.

Further, the coupling holes 310 are formed correspondingly to the coupling protrusions 214 in such a manner as to be spaced apart from each other at given intervals from one side of the glass member 300 to the other side thereof.

Among the coupling holes 310, in this case, the coupling holes 310 formed on the center of the glass member 300 have a shape of a circle, and the coupling holes 310 formed on both sides of the glass member 300 have a shape of an oval or long hole. Accordingly, the coupling protrusions 214 are inserted into the coupling holes 310 formed on the center of the glass member 300 in such a manner as to allow the glass member 300 to be bent, and next, the coupling protrusions 214 are inserted into the coupling holes 310 formed on both sides of the glass member 300. At this time, the coupling holes 310 formed on both sides of the glass member 300 are formed of the long holes, so that the coupling can be easily performed.

As described above, the glasses for a helmet according to the present invention is configured to rotate the glass member in the state where the glass member is mounted onto the helmet by means of one touch, thereby allowing the glass member to be located in front of the wearer's eyes, and configured to reversely rotate the glass member, thereby opening the front sides of his or her eyes, so that the glasses of the present invention provide many conveniences in use.

In addition, the glasses for a helmet according to the present invention is configured to mount the glass mounting members onto the helmet by means of the magnetic forces, thereby allowing the glass mounting members to be detachably mounted onto the helmet in a convenient manner.

Further, the glasses for a helmet according to the present invention is configured to insertedly mount the glass mounting members onto the helmet, so that the glass mounting members can be rigidly maintained in the mounted states on the helmet, while having no movements.

Furthermore, the glasses for a helmet according to the present invention is configured to allow the glass mounting members disposed on both sides of the glass member to be fixed to both sides of the helmet, so that the glass mounting members can be rigidly maintained in the mounted states onto the helmet and the glass member cannot rotate on the helmet.

Moreover, the glasses for a helmet according to the present invention is configured to allow the coupling protrusions formed on the glass mounting members to be inserted into the coupling holes formed on the glass member, so that the glass member cannot be easily separated from the glass mounting members.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. Glasses for a helmet comprising:

helmet attachment members (100) fixedly attached to the helmet (10) adapted to be worn on a wearer's head;

glass mounting members (200) separably mounted onto the helmet attachment members (100); and a glass member (300) adapted to rotate in a state of being rotatably fixed to the glass mounting members (200) in such a manner as to be located in front of wearer's eyes, wherein the glass mounting members (200) comprise:

a glass coupling part (210) separably coupled to the glass member (300);

rotation support parts (220) disposed on both sides of the glass coupling part (210);

rotation parts (230) separably fixed to the helmet attachment members (100) in a state of being rotatably fixed to the rotation support parts (220);

rotation stoppers (240) movably disposed in the rotation parts (230) in such a manner as to be supported against the rotation support parts (220) to maintain the rotating states of the rotation parts (230) in the rotation support parts (220); and fastening members (250) for rotatably fastening the rotation parts (230) to the rotation support parts (220), wherein each of the rotation parts (230) comprises:

a rotation pipe body (231) having an internal space penetrated on both ends thereof;

a rotation magnet (232) disposed on one end of the rotation pipe body (231) in such a manner as to be separably fixed to the corresponding helmet attachment member (100);

rotation pieces (233) disposed on both sides of an other side of the rotation pipe body (231) in such a manner as to be rotatably fastened to the rotation support part (220) by means of the fastening member (250); and guides (234) formed in an internal space of the rotation pipe body (231) to guide the movement of the rotation stopper (240).

2. The glasses for a helmet according to claim 1, wherein the helmet (10) has a plurality of mounting portions (11) formed open downward in an internal space thereof in such a manner as to mount the helmet attachment members (100) thereonto and the helmet attachment members (100) are inserted correspondingly into the mounting portions (11).

3. The glasses for a helmet according to claim 2, wherein the mounting portions (11) are formed of pipe bodies, and the helmet attachment members (100) comprise:

installation pipe bodies (110) insertedly fitted to the mounting portions (11) of the helmet (10);

installation magnets (120) disposed in the installation pipe bodies (110) for providing magnetic forces therefrom; and locking protrusions (130) formed on an outer peripheral surfaces of the installation pipe bodies (110) in such a manner as to be fixedly locked onto an inner peripheral surfaces of the mounting portions (11).

4. The glasses for a helmet according to claim 1, wherein the glass coupling part (210) comprises:

a base plate (211) supported against top of the glass member (300);

front plates (212) disposed extended forward from the base plate (211) in such a manner as to be supported against a front surface of the glass member (300);

rear plates (213) disposed extended backward from the base plate (211) in such a manner as to be supported against a rear surface of the glass member (300); and coupling protrusions (214) formed on the front plates (212) and the rear plates (213) in such a manner as to be coupled to the glass member (300), and the glass member (300) comprises coupling holes (310) coupled to the coupling protrusions (214) of the glass coupling part (210).

5. The glasses for a helmet according to claim 1, wherein each rotation support part (220) comprises:

a support rod (221) erected on the glass member (300);

a fixing body (222) disposed on top of the support rod (221) and having a fixing hole (224) formed thereon to fasten the corresponding fastening member (250) thereto; and a plurality of fixing protrusions (223) formed on the outer peripheral surface of the fixing body (222).

6. The glasses for a helmet according to claim 1, wherein each rotation stopper (240) comprises:

an elastic body (241) disposed in the internal space of the rotation part (230) to provide elasticity;

a stopper body (242) inserted into the internal space of the rotation part (230);

guide protrusions (243) formed on the stopper body (242) in such a manner as to be guided along the guides (234) of the rotation part (230) and supported against the elastic body (241); and stopper protrusions (244) formed on an end portion of the stopper body (242) in such a manner as to be supported against the rotation support part (220) of the corresponding glass mounting member (200).

7. The glasses for a helmet according to claim 1, wherein the guides (234) are formed on both sides of the internal space of the rotation pipe body (231), and the guide protrusions (243) are formed on both sides of the stopper body (242) in such a manner as to be inserted into the guides (234) to prevent the stopper body (242) from rotating.

* * * * *